US006126278A

United States Patent [19]

Yoshida

[11] Patent Number: 6,126,278

[45] Date of Patent: Oct. 3, 2000

[54] INK JET HEAD THAT MAKES INK DROPLET EJECTION VELOCITY UNIFORM WITHIN A PREDETERMINED RANGE REGARDLESS OF THE NUMBER OF INK CHAMBERS PRESSURIZED AT THE SAME TIME

[75] Inventor: Hitoshi Yoshida, Kounan, Japan

[73] Assignee: Brother Kogyo Kabushiki Kaisha, Nagoya, Japan

[21] Appl. No.: 08/825,620

[22] Filed: Mar. 31, 1997

[30] Foreign Application Priority Data

Apr. 15, 1996 [JP] Japan ..... 8-118517

[51] Int. Cl.[7] ..... B41J 2/045

[52] U.S. Cl. ..... 347/70; 347/10

[58] Field of Search ..... 347/10–12, 68–72, 347/48

[56] References Cited

U.S. PATENT DOCUMENTS

| | | | |
|---|---|---|---|
| 4,743,924 | 5/1988 | Scardovi | 347/10 |
| 5,764,247 | 6/1998 | Asai | 347/10 |
| 5,764,256 | 6/1998 | Zhang | 347/10 X |
| 5,818,481 | 10/1998 | Hotomi et al. | 347/68 |

*Primary Examiner*—John Barlow
*Assistant Examiner*—C Dickens
*Attorney, Agent, or Firm*—Oliff & Berridge, PLC

[57] ABSTRACT

There is provided a condition; $n \times T \leqq P \leqq (n+0.4) \times T$ between a pulse width P of the driving voltage that is to be applied to said piezoelectric element 7 of a piezoelectric plate 6 and a time T needed for that a pressure wave of ink, which generates when the ink chamber 2 is pressurized through the piezoelectric element 7, travels through the ink chamber by a length thereof. Under the condition, each of the piezoelectric elements 7 is driven. Here, the "n" is an integral odd number (preferably, 1 or 3).

6 Claims, 4 Drawing Sheets

(PRIOR ART)

INK JET HEAD THAT MAKES INK DROPLET EJECTION VELOCITY UNIFORM WITHIN A PREDETERMINED RANGE REGARDLESS OF THE NUMBER OF INK CHAMBERS PRESSURIZED AT THE SAME TIME

BACKGROUND OF THE INVENTION

1. Field of the Invention

The present invention relates to an ink jet head for ejecting ink droplets from nozzles each communicating with each of plural ink chambers formed in a cavity plate, on a recording sheet to record images such as characters, by applying a driving voltage to piezoelectric elements disposed with respect to the ink chambers respectively, thereby pressurizing the ink chambers. More particularly, the present invention relates to an ink jet head capable of making the ink ejection velocity uniform within a predetermined range regardless of the number of ink chambers to be pressurized at the same time through corresponding piezoelectric elements by setting a predetermined correlation between the pulse width of a driving voltage to be applied to piezoelectric elements and the time necessary for travelling of a pressure wave of ink through the ink chamber by a length thereof, the pressure wave generating when the piezoelectric element is pressurized.

2. Description of Related Art

Conventionally, with regard to ink jet heads, there have been studied on the correlation between the ejection velocity of ink droplet and the pulse width of a driving voltage applied to piezoelectric elements at the time of ejecting of ink droplets from nozzles communicating with corresponding ink chambers by applying a driving voltage to the piezoelectric elements each disposed correspondingly with each of the ink chambers. In general, it is known that the ejection velocity of ink droplets when ejected from nozzles varies periodically according to the pulse width of a driving voltage applied to piezoelectric elements.

For example, in the case that driving voltages having different pulse widths are applied to a piezoelectric element, pressurizing an ink chamber of an ink jet head thereby to eject ink droplets from a nozzle, such relationship as indicated by a curved line S1 (solid line) in FIG. 5 is seen between the ejection velocity of ink droplets and the pulse width of the driving voltage. In this case, if assuming "T" to be the time necessary for travelling of a pressure wave of ink by a length of the ink chamber, the pulse width of a driving voltage corresponds to the time T at the first peak point K1 (the left peak in FIG. 5) in the curved line S1, and the other pulse width of a driving voltage corresponds to the time 3T being three times the time T at the second peak point K2 (the right peak in FIG. 5).

In ink jet heads in the prior art, based on the correlation between the ink ejection velocity and the driving voltage applied to the piezoelectric element mentioned as above, the pulse width of a driving voltage for driving each piezoelectric element has been determined in consideration of the case of pressurizing plural ink chambers at the same time.

Meanwhile, the time T necessary for a pressure wave of ink, which generates when an ink chamber is pressurized, traveling by a length of the ink chamber is determined as follows;

$$T=L/\sqrt{(E_v/\rho)}$$

where L indicates the length of an ink chamber, $E_v$ indicates apparent modulus of elasticity of volume of ink, and ρ is the density of ink. This modulus of elasticity of ink volume $E_v$ has a property of varying according to the deformed amount of an ink chamber when pressurized and decreasing as the deformed amount of an ink chamber increases.

In the ink jet head, naturally, there is also the case of pressurizing a plurality of ink chambers at the same time, in addition to the above mentioned case of pressurizing only one of ink chambers in an ink jet head. Here, as an example opposite to the above case where an ink chamber alone is pressurized, the case where all ink chambers are pressurized at the same time will be reviewed below.

When all ink chambers are pressurized at the same time through respective corresponding piezoelectric elements, a cavity plate in which each ink chamber is formed may be deflected and deformed in a pressurized direction. The deflected and deformed amount of the cavity plate expectedly becomes larger as compared with the case of one ink chamber alone pressurized, so that the ink apparent volume elasticity modulus $E_v$ in each ink chamber becomes small as mentioned above. As is clear from the above formula, as the volume modulus of elasticity of ink $E_v$ becomes small, the time T becomes large. The ejection velocity of ink droplets ejected from nozzles when all ink chambers are pressurized at the same time changes periodically according to the width of a driving voltage applied to a piezoelectric element, when the curved line is entirely shifted in a side of larger pulse width. Specifically, as a curved line S2 (broken line) in FIG. 5, the pulse width of the driving voltage that may produce the same ink ejection velocity as in the curved line S1 is entirely shifted rightward in the graph, and both peak points K3 (the left peak in the graph) and K4 (the right peak) are also shifted rightward.

Consequently, as shown in FIG. 5, if the pulse width of a driving voltage being to be applied to a piezoelectric element is set to $P_A$, for instance, the velocity of ink droplet ejection when only one ink chamber is pressurized is $V_A$, while the velocity of ink droplet ejection when all ink chambers are pressurized is reduced to $V_B$. Regarding the ink droplet ejection velocity $V_A$ and $V_B$, it is necessary that both the velocities $V_A$ and $V_B$ are values more than a fixed value and also a difference between $V_A$ and $V_B$ is within a predetermined allowable range. If the $V_A$ and $V_B$ are not more than a fixed value and the difference is out of the predetermined allowable range, the ink droplet ejection velocity $V_A$ and $V_B$ may be changed depending on the number of ink chambers pressurized, causing deterioration in the printing quality.

SUMMARY OF THE INVENTION

The present invention has been made in view of the above circumstances and has an object to overcome the above problems and to provide an ink jet head capable of making the ejection velocity of ink droplet ejected from nozzles uniform within a predetermined range regardless of the number of ink chambers pressurized at the same time through piezoelectric elements, by establishing a predetermined correlation between the pulse width of a driving voltage that is to be applied to piezoelectric elements and the time necessary for travelling by a length of the ink chamber of a pressure wave of ink, which is generated when the piezoelectric element is pressurized.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, an ink jet head of this invention comprising a cavity plate in which a plurality of ink chambers are formed, a sheet member which covers an upper face of each of the ink chambers, a piezoelectric element disposed on each of the ink chambers, and a nozzle plate in which nozzles are formed each communicating with each ink chamber, the ink jet head ejects ink droplets from the nozzles by applying a driving voltage to each piezoelectric element thereby to pressurize each corresponding ink chamber, for printing characters and the like on a printing sheet, wherein provided is a condition; $n \times T \leqq P \leqq (n+0.4) \times T$, wherein "n" is an integral odd number, between a pulse width P of the driving voltage that is to be applied to the piezoelectric element and a time T needed for that a pressure wave of ink, which generates when the ink chamber is pressurized through the piezoelectric element, travels through the ink chamber by a length thereof, and said piezoelectric element is driven under the condition.

In the present invention, preferably, the "n" in the condition may be set to 1 or 3.

In another aspect of the present invention, the value 0.4 may be determined, considering a first ejecting velocity of the ink droplet in a first case that one ink chamber is pressurized and a second ejecting velocity of the ink droplets in a second case that all ink chambers are pressurized, so that one of the first and second ejecting velocities lies within a predetermined range of the other, and the predetermined range may be more than 80%.

In another aspect of the present invention, the first ejecting velocity may approximately become 10 m/s and the second velocity may approximately become 8.7 m/s when the pulse width P coincides with the time T, and the first ejecting velocity may approximately become 8 m/s and the second ejecting velocity may approximately become 10 m/s when the pulse width P coincides with the time 1.4T, while the "n" is set to 1 in the condition.

In another aspect of the present invention, the first ejecting velocity may approximately become 8.7 m/s and the second ejecting velocity may approximately become 10 m/s when the pulse width P coincides with the time 3T, and the first ejecting velocity may approximately become 6.8 m/s and the second ejecting velocity may approximately become 8.7 m/s when the pulse width P coincides with the time 3.4T, while the "n" is set to 3 in the condition.

According to the above ink jet head of the present invention, even if the ink ejection velocity (B) when all ink chambers are pressurized at the same time is shifted in a side of the pulse width P of the driving voltage becoming larger than that in the ink ejection velocity (A) when one ink chamber is only pressurized, each ink ejection velocity can be determined within a predetermined range of the other velocity whereby no deterioration in the quality of printing is caused.

Here, the predetermined range of causing no deterioration in the quality of printing means that the difference between the ink ejection velocities A and B lies within a predetermined range. For example, if one of the ink ejection velocities is in the range of more than about 80% of another velocity, there will occur no problem in the printing quality. To the contrary, if the ink ejection velocity are mutually out of the 80% range, i.e., less than 80% of another ejection velocity as mentioned above, the difference between the ink ejection velocities A and B is too large, resulting in deterioration in the printing quality.

As described above, the ink ejection velocity (B) when all ink chambers are pressurized at the same time and the other ink ejection velocity (A) when one ink chamber alone is pressurized are set in a predetermined range with respect to each other so that the printing quality does not deteriorate. As a result, even in other case that some ink chambers are pressurized at the same time, each ink ejection velocity can be set within a predetermined range, making it possible to make ejection velocity of ink ejected from nozzles uniform within a predetermined range regardless of the number of ink chambers each pressurized simultaneously through each piezoelectric element, thus performing excellent printing.

According to the ink jet head mentioned above, the "n" in the condition may be 1 or 3. In both cases where only one ink chamber is pressurized or all ink chambers are pressurized at the same time, respective ink ejection velocities tend to decrease as the value of "n" increases; however, when the "n" is set to a value up to 3, a sufficient velocity of ink ejection can be obtained.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of one preferred embodiment of an ink jet head embodying the present invention will now be given referring to the accompanying drawings.

Figure 1:
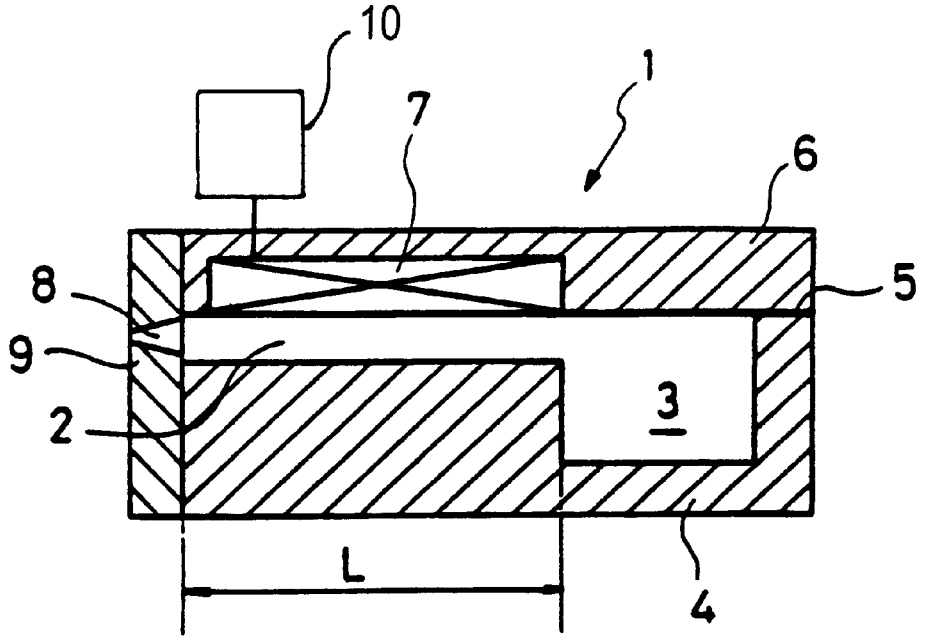
FIG. 1 is a cross-sectional side view of an ink jet head in the embodiment according to the present invention.
Figure 2:
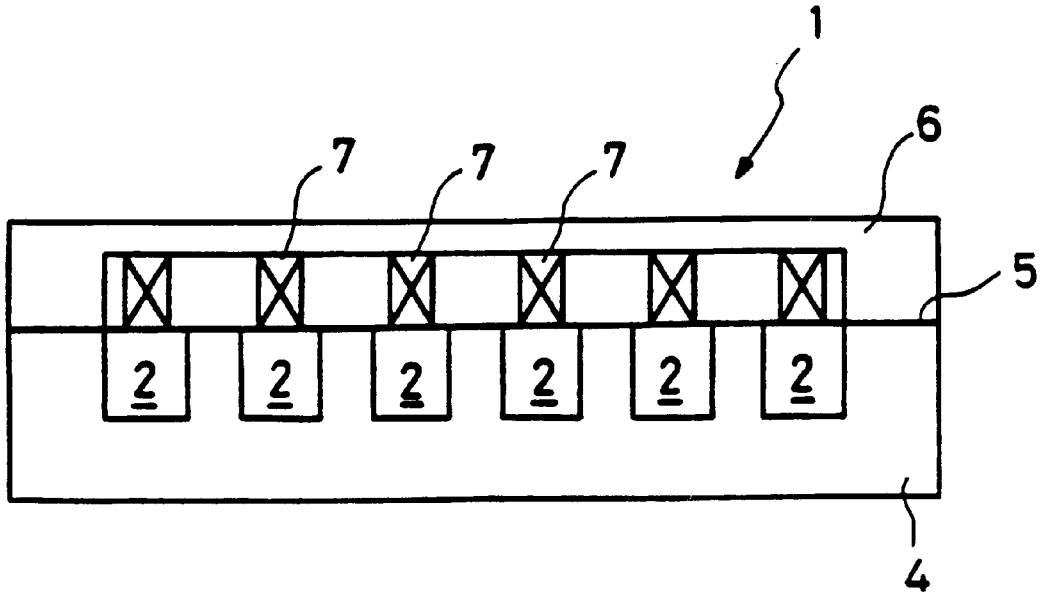
FIG. 2 is a front view of the ink jet head from which a nozzle plate is omitted.

Construction of the ink jet head in the embodiment will schematically be explained with reference to FIG. 1 showing a cross-sectional side view of the ink jet head and FIG. 2 showing a front view of the same, in which a nozzle plate has been removed to facilitate understanding.

In FIGS. 1 and 2, an ink jet head 1 has a cavity plate 4 formed of an alumina sintered body in which a plurality of ink chambers 2 with a length L and ink manifolds 3 which communicate with the ink chambers 2 respectively are formed through a cutting work. Each ink manifold 3 is supplied with ink from an ink supply unit (not shown) mounted on an ink jet printer and supplies the ink to the ink chamber 2. At an upper face of the cavity plate 4 is adhered a vibrating sheet 5 formed of aramid film for shielding the upper faces of the ink chamber 2 and the ink manifold 3.

On the upper side of the vibrating sheet 5 opposite to the cavity plate 4, a piezoelectric plate 6 formed of piezoelectric materials such as PZT is disposed. In the piezoelectric plate 6, piezoelectric elements 7 are provided correspondingly with the ink chambers 2 so as to be each in contact at the lower part with the vibrating sheet 5. Each piezoelectric element 7 is provided thereon with a predetermined electrode pattern (not shown). This piezoelectric element 7 vibrates downward in FIGS. 1 and 2 when a driving voltage is applied by a generator 10 to the electrode pattern, pressing the vibrating sheet 5, and thereby exerting pressure on the ink chamber 2. Each construction of the piezoelectric plate 6 and the piezoelectric element 7 has been well known and the detail explanation thereof is omitted from the present specification.

In a front end (a left end in the drawing) of the ink jet head 1, fixed is a nozzle plate 9 in which nozzle orifices 8 are formed in correspondence to the ink chambers 2 respectively. When a driving voltage is applied to the piezoelectric element 7, pressing the vibrating sheet 5 and the ink chamber 2 as mentioned above, ink droplets are ejected at a predetermined velocity from the ink chamber 2 through each nozzle orifice 8 of the nozzle plate 9. This ink ejection performs printing of images such as characters on a recording sheet arranged opposite to the ink jet head 1.

In the ink jet head 1 constructed as above, there exists the following relation;

$$n \times T \leqq P \leqq (n+0.4) \times T$$

between the pulse width P of a driving voltage to be applied to each piezoelectric element 7 and the time T necessary for a pressure wave of ink to travel through the ink chamber 2 by a length L thereof, the pressure wave of ink generating when the ink chamber 2 is pressurized through the piezoelectric element 7. Here, the above "n" is an integral odd number and, specifically, set to 1 or 3. Accordingly, the relation between the pulse width P and the time T is $T \leqq P \leqq 1.4 \times T$ when "n" is 1 and $3T \leqq P \leqq 3.4 \times T$ when "n" is 3. The value, 0.4 in the above relative equation is a coefficient obtained by experiment so that one ejection velocity comes in a predetermined range of, for instance, more than 80% of another ejection velocity, which will be explained in detail later, between the ejection velocity of ink to be ejected from the nozzle orifice(s) 8 when one ink chamber 2 is pressurized and the same when all ink chambers 2 are pressurized at the same time.

Figure 3:
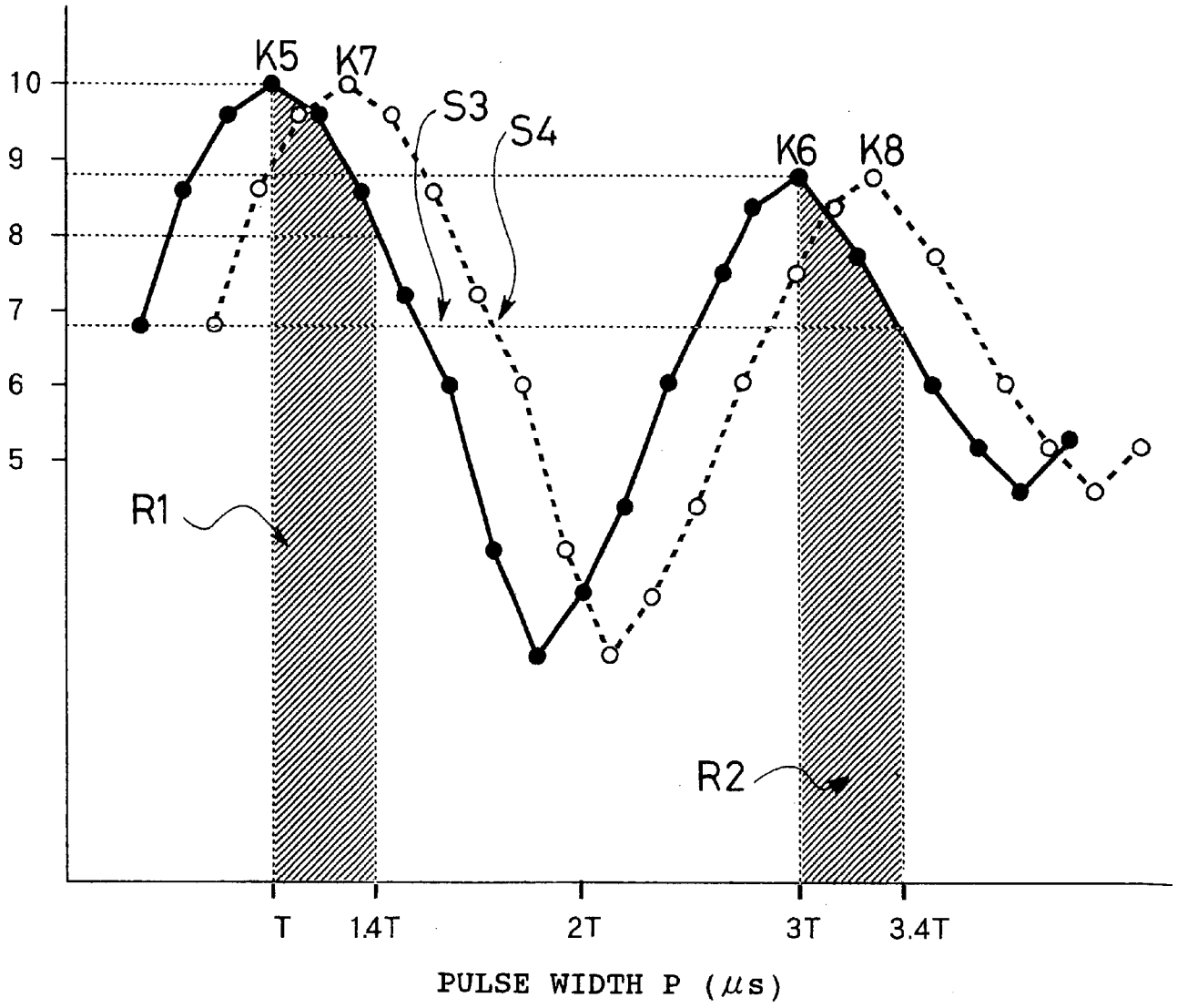
FIG. 3 is a graph showing the correlation between the pulse width and the ink ejection velocities both obtained in pressurizing one ink chamber alone, and the correlation between those obtained in pressurizing all ink chamber at the same time.

Using the ink jet head 1 with the above mentioned predetermined correlation between the pulse width P of a driving voltage and the time T, the relation between the pulse width P and the ink ejection velocity V has been measured in both cases of pressurizing one of ink chambers 2 through the piezoelectric element 7 and all ink chambers 2 through the piezoelectric elements 7 respectively, where the pulse width P was represented by the time T and made to increase gradually. The measurement results are shown in FIG. 3 as a graph showing each of the relations between the pulse width P and the ink ejection velocity V in pressurizing one ink chamber 2 alone and between the pulse width P and the ink ejection velocity V in pressurizing all ink chambers 2 at the same time. In the graph of FIG. 3, a horizontal axis indicates the pulse width P (micro second; $\mu$s) represented by the time T and a vertical line indicates the velocity of ink ejection V (m/s).

At first, the measurement result when one of the ink chambers 2 is pressurized will be explained. The measurement result in this case is shown by a curved line S3 (filled dots with a solid line connecting them) in FIG. 3. The ink ejection velocity V varies periodically according to the pulse width P as well as in the ink jet head in the prior art, and the ink ejection velocity V becomes a first peak value K5; 10 m/s in the embodiment at the time of the pulse width P being the time T. The ink ejection velocity V is about 8 m/s at the time of the pulse width P coinciding with one point four times the time T, i.e., 1.4T. The ink ejection velocity V becomes a second peak value K6; about 8.7 m/s when the pulse width P coincides with three times the time T, i.e., 3T and about 6.8 m/s when P is three point four times the time T, i.e., 3.4T.

Figure 4:
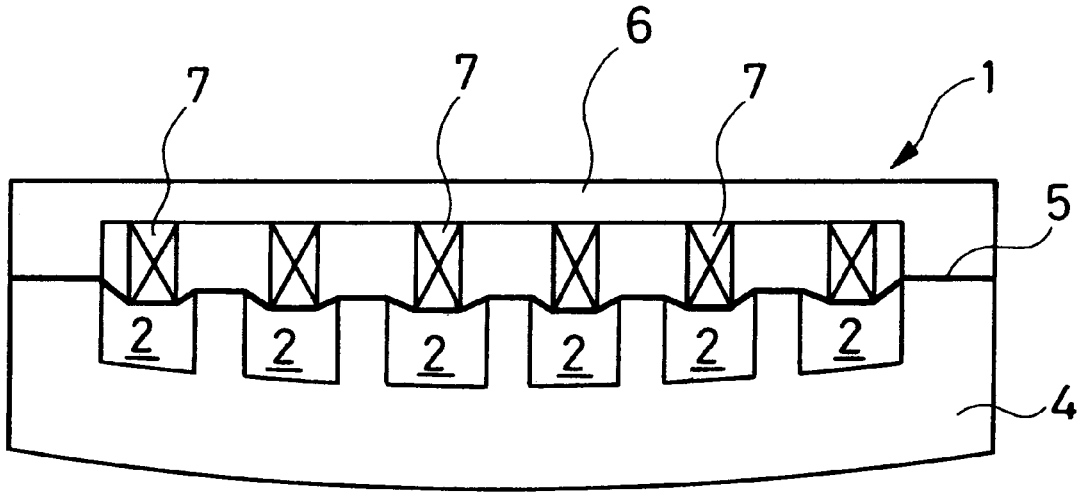
FIG. 4 is a front view of an ink jet head from which a nozzle plate is omitted, when all ink chambers are pressurized at the same time.
Figure 5:
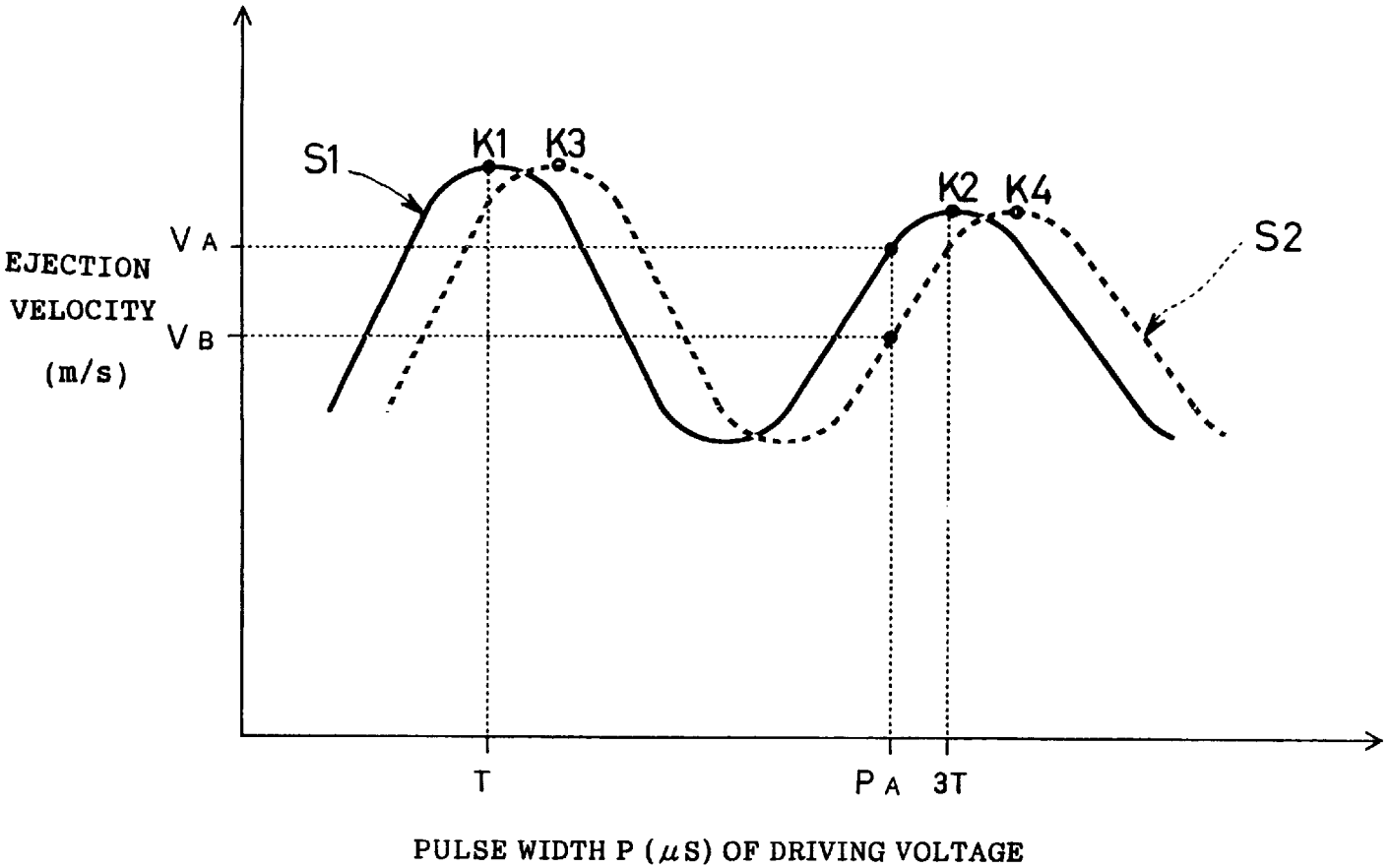
FIG. 5 is a graph showing the correlation between the pulse width and the ink ejection velocities both obtained in pressurizing one ink chamber of an ink jet head in the prior art, and the correlation between those obtained in pressurizing all ink chambers.

Next, as shown in FIG. 4, the pulse width P and the ink ejection velocity V when all of the ink chambers 2 are pressurized have been measured. The measured results are shown by a curved line S4 (a broken line with circles) in FIG. 3. At this time, each of the piezoelectric elements 7 in the piezoelectric plate 6 of the ink jet head 1 is made to extend through the vibrating sheet 5 toward the ink chamber 2, when the cavity plate 4 is bent and deformed downward resulted from that all ink chambers 2 are pressurized. Such the deformed cavity plate 4 causes the apparent volume modulus of ink in each ink chamber 2 to decrease, so that the time T becomes larger and thereby the first peak value K7; 10 m/s and the second peak value K8; approximately 8.7 m/s of a curved line S4 are shifted rightward respectively from the peak values K5 and K6 in the curved line S3.

That is to say, the ink ejection velocity V in the curved line S4 varies periodically according to the pulse width P as well as in the curved line S3, while it becomes the first peak value K7 (10 m/s) when the pulse width P is 1.4T and the second peak value K8 (about 8.7 m/s) when the pulse width P is 3.4T.

Here, the correlation between the pulse width P and the ink ejection velocity V in each of the curved lines S3 and S4 will be examined below.

At the time of the pulse width P coinciding with the time T, the ink ejection velocity V in the curved line S3 is the first peak value K5 (10 m/s) and that in the curved line S4 is approximately 8.7 m/s. At this time, the ink ejection velocity in the curved line S4 corresponds to about 88% of the first peak value K5, i.e., it is in the range of more than 80% of the ink ejection velocity in the curved line S3. If the pulse width P is set to coincide with the time T, accordingly, it is possible to printing characters and the like without deterioration in the print quality.

When the pulse width P is one point four times the time T (1.4T), the ink ejection velocity in the curved line S3 is approximately 8 m/s, that in the curved line S4 is the first peak value K7 (10 m/s), where the ink ejection velocity V in the curved line S3 corresponds to about 80% of that in the curved line S4. If the pulse width P is set to be 1.4T, similarly to the above case, printing characters and the like can be performed without problems in the quality of print.

As is clear from the above description, if the pulse width P is set so as to satisfy a relation $T \leqq P \leqq 1.4T$, one ink ejection velocity V can be in the range of more than 80% of another ink ejection velocity V in both cases that one ink chamber 2 alone is pressurized and all ink chambers 2 are simultaneously pressurized, so that characters and the like can be printed without deterioration in the printing quality. The range of the pulse width P in which a print operation can satisfactorily be performed is indicated by R1 in FIG. 3.

If the pulse width P is three times the time (3T), the ink ejection velocity V in the curved line S3 is the second peak value K6 (8.7 m/s) and that in the curved line S4 is about 7.4 m/s. This ink ejection velocity V in the curved line S4 is in the range of more than 80% of the second peak value K6. Consequently, if the pulse width P is set to be three times the time T (3T), it is possible to print characters and the like without difficulties in the quality of print.

Furthermore, when the pulse width P is three point four times the time T (3.4T), the ink ejection velocity in the curved line S3 is approximately 6.8 m/s and that in the curved line S4 is the second peak K8 (8.7 m/s). At this time, the ink ejection velocity in the curved line S3 corresponds to about 80% of that in the curved line S4, so that setting the pulse width P to be 3.4t makes it possible to perform a printing operation satisfactorily as well as in the above case.

In this way, if the pulse width P is determined satisfying a relation $3T \leqq P \leqq 3.4T$, one ink ejection velocity V can be in the range of more than 80% of another ink ejection velocity V in both cases that one ink chamber 2 alone is pressurized and all ink chambers 2 are simultaneously pressurized, so that characters and the like can be printed without deterioration in the printing quality. The range of the pulse width P in which a print operation can satisfactorily be performed is indicated by R2 in FIG. 3.

As explained above in detail, the ink jet head 1 in the present embodiment is constructed so that the relation; $n \times T \leqq P \leqq (n+0.4) \times T$ is set between the pulse width P of a driving voltage to be applied to the piezoelectric element 7 of the piezoelectric plate 6 and the time T necessary for that a pressure wave of ink which generates when the ink chamber is pressurized through the piezoelectric element 7 travels through the ink chamber 2 by a length thereof, and each piezoelectric element 7 is driven based on the above condition. Even when the ink ejection velocity V when all ink chambers 2 are pressurized at the same time is shifted in a side of the pulse width P becoming larger with respect to the ink ejection velocity V when only one of the ink chambers 2 is pressurized, each ink ejection velocity V can be set within such a predetermined range that no deterioration in the quality of print occurs, namely, the range where one ink ejection velocity is more than 80% of another ink ejection velocity.

As a result, since the ink ejection velocity V when pressurizing all of the ink chambers 2 at the same time and that when pressurizing one of them are determined having a correlation therebetween as above, each ink ejection velocity is set in the predetermined range also when plural ink chambers 2 are pressurized at the same time, so that the velocity of ink droplets ejected from the nozzle orifices can be made uniform in a predetermined range regardless of the number of ink chambers 2 simultaneously pressurized through each piezoelectric element 7, making it possible to realize a satisfactory printing.

In the ink jet head 1, furthermore, in both cases of pressurizing one ink chamber 2 alone and all ink chambers 2 at the same time, the respective ink ejection velocities V tend to gradually decrease as the value "n" in the condition increases, while if the value "n" is set to 3 or less, a satisfactory velocity of ink ejection can be obtained.

The present invention may be embodied in other specific forms without departing from the spirit or essential characteristics thereof.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An ink jet head system for printing characters on a printing sheet via ink droplets upon application of a driving voltage, comprising:

a cavity plate in which a plurality of ink chambers are formed, each ink chamber having a length;

a sheet member adhered on an upper face of the cavity plate to cover upper faces of the ink chambers;

a plurality of piezoelectric elements, each piezoelectric element being disposed on the sheet member at a location corresponding to each ink chamber, each piezoelectric element being driven to pressurize the corresponding ink chamber and to generate a pressure wave in ink by applying the driving voltage;

a nozzle plate having nozzles, each nozzle communicating with each ink chamber, through which the ink droplets are ejected from the ink chambers to print characters when the piezoelectric element is driven; and means for driving the plurality of piezoelectric elements, the means for driving being able to drive only one of the plurality of piezoelectric elements, the means for driving also being able to drive multiple piezoelectric elements at substantially the same time, the means for driving driving at least one of the piezoelectric elements in accordance with a condition; $n \times T \leqq P \leqq (n+0.4) \times T$, wherein the "n" is an integral odd number, between a pulse width P of the driving voltage applied to said piezoelectric element and a time T needed for the pressure wave of ink, which generates when the ink chamber is pressurized through the piezoelectric element, to travel through the ink chamber by the length, and said piezoelectric element is driven under said condition, such that an ejecting velocity of the ink droplet is set in a predetermined range regardless of whether the means for driving drives only one piezoelectric element or multiple piezoelectric elements.

2. An ink jet head system according to claim 1, wherein said "n" in the condition is set to 1 or 3.

3. An ink jet head system according to claim 2, wherein the "0.4" in the condition is determined, considering a first ejecting velocity of the ink droplet in a first case that one of the ink chambers is pressurized and a second ejecting velocity of the ink droplets in a second case that all of the ink chambers are pressurized, so that one of the first ejecting velocity and the second ejecting velocity lies within a predetermined range of the other of the first ejecting velocity and the second ejecting velocity.

4. An ink jet head system according to claim 3, wherein the predetermined range is more than 80% in a ratio between one of the first ejecting velocity and the second ejecting velocity and the other of the first ejecting velocity and the second ejecting velocity.

5. An ink jet head system according to claim 3, wherein the first ejecting velocity approximately becomes 10 m/s and the second velocity approximately becomes 8.7 m/s when the pulse width P coincides with the time T, and the first ejecting velocity approximately becomes 8 m/s and the second ejecting velocity approximately becomes 10 m/s when the pulse width P coincides with the time 1.4T, while the "n" is set to 1 in the condition.

6. An ink jet head system according to claim 3, wherein the first ejecting velocity approximately becomes 8.7 m/s and the second ejecting velocity approximately becomes 10 m/s when the pulse width P coincides with the time 3T, and the first ejecting velocity approximately becomes 6.8 m/s and the second ejecting velocity approximately becomes 8.7 m/s when the pulse width P coincides with the time 3.4T, while the "" is set to 3 in the condition.

* * * * *